US005670242A

United States Patent [19]

Asano et al.

[11] Patent Number: 5,670,242

[45] Date of Patent: Sep. 23, 1997

[54] CAST COATED PAPER FOR INK JET RECORDING

[75] Inventors: Shinichi Asano, Kobe; Hiroyuki Ohashi, Neyakawa; Hiromasa Kondo, Urawa; Kazuhiro Nojima, Kobe; Katsuyoshi Imabeppu, Amagasaki; Mamoru Sakaki, Yamato; Eiichi Suzuki, Asaka, all of Japan

[73] Assignees: Canon Kabushiki Kaisha; OJI Paper Co., Ltd., both of Tokyo, Japan

[21] Appl. No.: 260,964

[22] Filed: Jun. 15, 1994

[30] Foreign Application Priority Data

| | | | |
|---|---|---|---|
| Jun. 15, 1993 | [JP] | Japan | 5-143587 |
| Jul. 30, 1993 | [JP] | Japan | 5-189517 |
| Sep. 13, 1993 | [JP] | Japan | 226938 |

[51] Int. Cl.[6] ..... B41J 2/01

[52] U.S. Cl. ..... 428/212; 428/195; 428/211; 428/304.4; 428/329; 428/331

[58] Field of Search ..... 428/195, 211, 428/500, 411.1, 522, 212, 304.4, 329, 331

[56] References Cited

U.S. PATENT DOCUMENTS

| | | | |
|---|---|---|---|
| 4,265,969 | 5/1981 | Yasuda et al. | 428/342 |
| 4,301,210 | 11/1981 | Yasuda et al. | 428/342 |
| 4,613,525 | 9/1986 | Miyamoto et al. | 428/211 |
| 4,636,805 | 1/1987 | Toganoh et al. | 346/1.1 |
| 4,664,952 | 5/1987 | Arai et al. | 427/256 |
| 4,686,118 | 8/1987 | Arai et al. | 427/261 |
| 4,756,963 | 7/1988 | Yamamoto et al. | 428/334 |
| 4,758,461 | 7/1988 | Akiya et al. | 428/212 |
| 4,780,348 | 10/1988 | Yamamoto et al. | 428/43 |
| 4,785,313 | 11/1988 | Higuma et al. | 346/135.1 |
| 4,832,984 | 5/1989 | Hasegawa et al. | 427/161 |
| 4,877,680 | 10/1989 | Sakaki et al. | 428/332 |
| 4,910,084 | 3/1990 | Yamasaki | 428/411.1 |
| 4,956,223 | 9/1990 | Arai et al. | 428/212 |
| 4,965,612 | 10/1990 | Sakaki et al. | 346/1.1 |
| 5,041,328 | 8/1991 | Akiya et al. | 428/212 |
| 5,081,470 | 1/1992 | Kurabayashi et al. | 346/1.1 |
| 5,101,218 | 3/1992 | Sakaki et al. | 346/1.1 |
| 5,137,778 | 8/1992 | Nakatsugawa et al. | 428/330 |
| 5,182,175 | 1/1993 | Sakaki et al. | 428/537.5 |
| 5,246,774 | 9/1993 | Sakaki et al. | 428/323 |
| 5,275,846 | 1/1994 | Imai et al. | 427/362 |
| 5,277,962 | 1/1994 | Nakatsugawa et al. | 428/206 |

FOREIGN PATENT DOCUMENTS

| | | |
|---|---|---|
| 54-59936 | 5/1979 | Japan . |

*Primary Examiner*—Pamela R. Schwartz

*Attorney, Agent, or Firm*—Fitzpatrick, Cella, Harper & Scinto

[57] ABSTRACT

A cast coated paper for ink jet recording is constituted to include, in lamination: a base paper, an undercoating layer comprising a pigment and an adhesive, and a cast-coating layer comprising a polymer having a glass transition point of at least 40° C. formed by polymerization of an ethylenically unsaturated monomer. The cast coated paper is preferably controlled to have an air permeability of at most 300 sec/100 cc. The undercoating preferably contains a cationic resin, particularly preferably a copolymer of a polyalkylenepolyamine and dicyandiamide. The cast coated paper thus produced with an excellent ink absorptivity suitable for ink jet recording while retaining a high surface gloss.

12 Claims, 2 Drawing Sheets

CAST COATED PAPER FOR INK JET RECORDING

FIELD OF THE INVENTION AND RELATED ART

The present invention relates to a cast-coated paper for ink jet recording. More particularly, the present invention relates to a cast coated paper having an excellent gloss in its as-produced state or before-printed state and particularly suitable for ink jet recording (printing), a process for producing the paper and an ink jet recording method using the paper.

In recent years, ink jet recording as represented by recording by means of an ink jet printer, has been intensively used because of low noise characteristic, capability of high speed recording and facility of multi-color recording.

Conventionally used ink jet recording papers have typically included high-quality or wood-free papers designed to have a high ink absorptivity and coated papers having surface coating of porous pigment. Such ink jet recording papers generally have a low surface gloss and have a feel of so-called mat paper.

However, accompanying increasing demands on ink jet recording, such as higher speed recording, higher resolution of recorded image and full color image formation, there has been also desired an ink jet recording paper having a high surface gloss and excellent appearance.

Known typical high-gloss papers include a high-gloss coated paper prepared by surface-coating with a plate-shaped pigment, followed by calendering, and a so-called cast coated paper prepared by pressing a wet-coated surface against a heated metal drum having a mirror-finished surface and drying the coated surface to copy a mirror-like surface of the drum.

The cast coated paper is provided with a higher surface gloss and a better surface smoothness compared with an ordinary coated paper finished by super-calendering and shows excellent printing performance. For this reason, the cast coated paper has been generally used for providing high-class prints but is still accompanied with several difficulties.

More specifically, a conventional cast coated paper has been prepared to have a high gloss by copying a mirror-finished drum surface of a coater with a film-forming substance, such as an adhesive, included together with a pigment in the coating layer composition. On the other hand, the film-forming substance is liable to deprive the coating layer of a porosity and remarkably lower the ink absorptivity or penetrability required in ink jet recording. In order to improve the ink absorptivity, it is important to form a porous cast-coating layer, and the reduction in amount of the film-forming substance is required for that purpose. The reduction of the film-forming substance, however, results in a lower gloss of the cast coated paper in its as-produced state.

As described above, it is very difficult to satisfy the surface gloss and the recording performance (printability) in ink jet recording of a cast coated paper in combination under the present circumstances.

SUMMARY OF THE INVENTION

Accordingly, it is an object of the present invention to provide a cast coated paper having an excellent surface gloss, a surface smoothness and ink jet recording performances in combination.

Another object of the present invention is to provide a process for producing such a cast coated paper.

A further object of the present invention is to provide an ink jet recording method using such a gloss paper.

As a result of extensive study, it has been found possible to obtain a cast coated paper which not only retains a high gloss characteristic of a conventional cast coated paper but also has excellent ink jet recording (printing) performance not obtainable by a conventional cast coated paper, by applying a cast-coating liquid or overcoating liquid containing a polymer having a specific glass transition point onto an undercoated base paper and cast-finishing the coating layer.

According to the present invention accomplished based on the above knowledge, there is provided a cast coated paper for ink jet recording, comprising, in lamination: a base paper, an undercoating layer comprising a pigment and an adhesive, and a cast-coating layer comprising a polymer having a glass transition point of at least 40° C. formed by polymerization of an ethylenically unsaturated monomer. In a preferred embodiment, the cast coated paper is constituted to have an air permeability (herein, expressed in terms of a resistance to air passage therethrough) of at most 300 sec./100 cc. In a still preferred embodiment, the undercoating layer is caused to contain a cationic resin, particularly preferably a copolymer of polyalkylenepolyamine and dicyandiamide.

According to another aspect of the present invention there is provided a gloss paper for ink jet recording, comprising, in lamination: a substrate, an undercoating layer comprising a pigment and an adhesive, and an overcoating layer comprising a polymer having a glass transition point of at least 40° C. formed by polymerization of an ethylenically unsaturated monomer.

According to another aspect of the present invention there is provided a process for producing a cast coated paper for ink jet recording, comprising the steps of: forming on a base paper an undercoating layer comprising a pigment and an adhesive, applying onto the undercoating layer an overcoating liquid comprising a polymer of an ethylenically unsaturated monomer having a glass transition point of at least 40° C. to form a wet overcoating layer, and pressing the wet overcoating layer against a heated drum having a mirror-finished surface to dry the overcoating layer, thereby forming a cast-coating layer.

According to another aspect of the present invention there is provided an ink jet recording method, comprising: ejecting an aqueous ink through a minute orifice onto a gloss paper, wherein said gloss paper comprises in lamination: a base paper, an undercoating layer comprising a pigment and an adhesive, and an overcoating layer comprising a polymer having a glass transition point of at least 40° C. formed by polymerization of an ethylenically unsaturated monomer.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
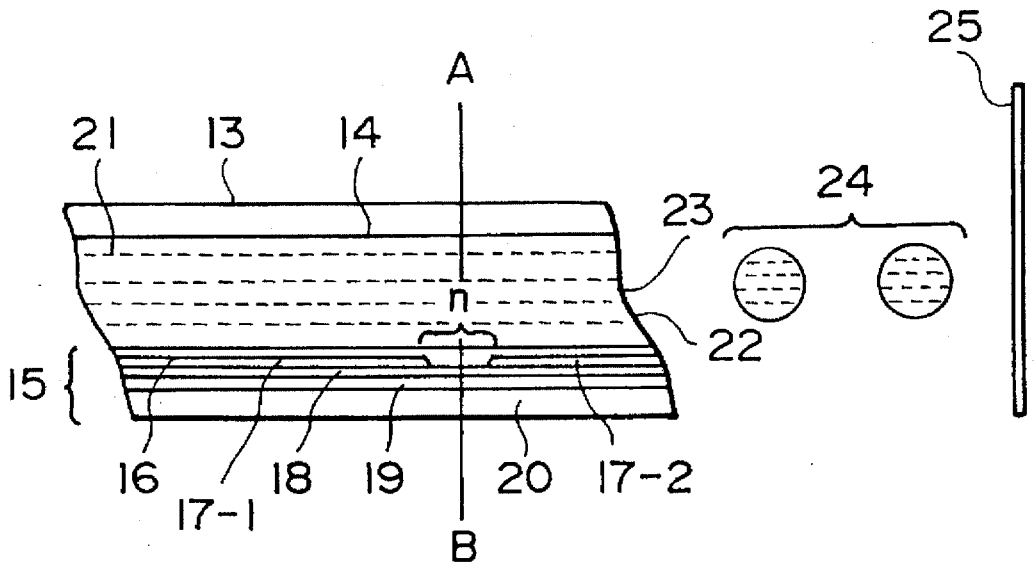
FIG. 1 is a longitudinal sectional view of a recording head part of an ink jet recording device.

As described above, according to an embodiment of the present invention, a cast coated paper for ink jet recording retaining an excellent surface gloss and also provided with excellent ink jet recording (printing) performance is provided by applying an overcoating or cast-coating liquid containing a polymer having a specific glass transition point onto a base paper already provided with an undercoating layer comprising a pigment and an adhesive to form a cast-coating layer, and cast finishing the coating layer.

The cast-coating liquid comprises an ordinarily aqueous cast-coating composition containing a polymer having a glass transition point of at least 40° C. and formed by polymerization of an ethylenically unsaturated monomer, i.e., a monomer having an ethylenically unsaturated bond.

Examples of the ethylenically unsaturated monomer giving the polymer contained in the cast-coating liquid may include: acrylates having a $C_1$–$C_{18}$ alkyl group, such as methyl acrylate, ethyl acrylate, butyl acrylate, 2-ethylhexyl acrylate, lauryl acrylate, 2-hydroxyethyl acrylate, and glycidyl acrylate; methacrylates having a $C_1$–$C_{18}$ alkyl group, such as methyl methacrylate, ethyl methacrylate, 2-hydroxyethyl methacrylate, 2-hydroxypropyl methacrylate, and glycidyl methacrylate; and other ethylenically unsaturated monomers, such as styrene, α-methylstyrene, vinyl-toluene, acrylonitrile, vinyl chloride, vinylidene chloride, vinyl acetate, vinyl propionate, acrylamide, N-methylolacrylamide, ethylene and butadiene. It is also possible to copolymerize such an ethylenically unsaturated monomer with another monomer to an extent not adversely affecting the effect of the present invention.

Particularly preferred examples of the polymer formed by polymerization of such an ethylenically unsaturated monomer may include: styrene-acrylate copolymer and styrene-methacrylate copolymer.

As is understood from the above preferred examples, the polymer can be a copolymer of two or more ethylenically unsaturated monomers. Further, these polymers or copolymers can be used in the form of a substitution derivative, examples of which may include: carboxylation and conversion into an alkali-reactive form of the carboxylated derivative. Further, such a polymer can be included in the cast-coating liquid in a composite form, e.g., a composite with colloidal silica connected via Si—O—R bond (wherein R represents a polisher component) formed by polymerizing an ethylenically unsaturated monomer in the presence of colloidal silica.

As described above, the polymer of an ethylenically unsaturated monomer has a glass transition point of at least 40° C. and may preferably have a glass transition point of ca. 50° C.–ca. 90° C., more preferably ca. 70° C.–ca. 90° C.

The glass transition point of the polymer may be controlled by selecting the species of the ethylenically unsaturated monomer and the crosslinking degree of the polymer. For example, the glass transition point may be increased by increasing the content of a monomer capable of providing a polymer having a relatively high glass transition point, such as styrene, to 50 wt. % or more.

Into the cast-coating composition, it is also possible to add a pigment such as colloidal silica in an amount of ordinarily 0–200 wt. parts per 100 wt. parts of the above-mentioned polymer. Colloidal silica may have an average particle size of ca. 0.01–0.2 μm, while it is not restricted thereto.

In a conventional cast coated paper, a resin in the cast-coating liquid has been sufficiently converted into a film form in the cast-finishing step so as to provide an excellent surface gloss. According to such a method, however, the porosity of the resultant cast coated paper surface is reduced to result in a lower ink absorptivity which is not desirable in ink jet recording.

In the present invention, a polymer having a high glass transition point is used so as to obviate the lowering in ink absorption, whereby a cast-coating layer can be finished without causing complete film-formation of the polymer. As a result, the reduction in porosity of the cast coated paper surface is only slight, so that a cast-coating surface is only slight, and thus a cast-coating surface having an excellent gloss can be formed without a substantial lowering in ink absorptivity. If the polymer in the cast-coating composition has a glass transition point of below 40° C., the polymer is liable to cause excessive film formation due to heat from the casting drum surface, thus causing a lower porosity leading to a lower ink absorptivity of the cast coated paper surface.

The cast-coating composition used in the present invention can be constituted by only the above-mentioned polymer having a specific glass transition but can further contain a release agent or casein, soybean protein, etc., so as to provide an improved releasability. It is also possible to incorporate a cationic resin, such as those having a tertiary amino group or a quaternary ammonium group so as to improve the fixability and water resistance of the recorded ink images after ink jet recording. It is also possible to add, as desired, optional additives, such as pigments, dispersing agents, thickening agents, deforming agents, colorants, antistatic agents and antiseptics, which are generally used for preparing ordinary coated papers and ink jet recording papers.

In the present invention, the above-mentioned cast-coating composition including a specific polymer is applied onto an undercoating layer disposed in advance on a base paper, If the cast-coating composition is directly applied onto a base paper and cast-finished, the resultant cast coated paper is liable to be accompanied with surface defects, such as pinholes, since uncoated base paper has remarkably inferior surface smoothness compared with an undercoated base paper.

In a preferred embodiment of the present invention, the cast coated paper is controlled to have an air permeability of at most 300 sec/100 cc as measured according to JIS-P-8117 so as to provide an excellent ink absorptivity. The air permeability may be defined as the time in which 100 ml of air under a load of a freely moving inner cylinder (567±1.0 g) passes through 645 $mm^2$ of a sample paper. A cast coated paper having an air permeability exceeding 300 sec/100 cc as measured according to JIS-P-8117 may have a high surface gloss but is liable to have a lower ink absorptivity.

The lower limit of the air permeability is not particularly limited, but an air permeability of at least 5 sec/100 cc, particularly 10–200 sec/100 cc, is preferred.

As a measure for providing a cast coated paper having an air permeability according to JIS-P-8117 of at most 300 sec/100 cc, it is preferred that the base paper after being provided with an undercoating layer is controlled to have a Gurley air permeability (i.e., an air permeability measured by using a Gurley high pressure-type air permeability tester according to ASTM-D-726, B method) of at most 30 sec/10 cc. A lower Gurley air permeability value means a good permeability or smaller resistance to air passage through a sample similarly as the air permeability value according to JIS-P-8117. If the Gurley air permeability exceeds 30 sec/10 cc, the resultant cast coated paper is liable to show a lower ink absorptivity at the time of ink jet recording, and the operation efficiency during the cast-finishing can be also lowered.

The undercoating layer contains a pigment and an adhesive.

Examples of the pigment may include various known pigments used in ordinary coated papers, such as kaolin, clay, calcined clay, amorphous silica, zinc oxide, aluminum oxide, aluminum hydroxide, calcium carbonate, satin white, aluminum silicate, smectite, magnesium silicate, magnesium carbonate, magnesium oxide, diatomaceous earth, styrene-based plastic pigment, urea resin-based plastic pigment, and benzoquanamine-based plastic pigment.

Among the above-mentioned pigments, it is particularly preferred to use a porous pigment, such as amorphous silica or alumina, so as to provide a cast coated paper having improved ink absorptivity and image density of recorded images at the time of ink jet recording. This is related to a lower air permeability value caused by the use of amorphous silica or alumina having a very porous structure resulting in a large amounts of pores or voids in the coating layer. Though not restrictive, amorphous silica and alumina may respectively have an average particle size of ca. 0.1–μm.

Further, such a porous pigment has a high transparency so that the coloring with an ink dye absorbed in the coating is not hindered thereby, thus providing an improved image density of the recorded images. Such a porous pigment may preferably be contained in a proportion of at least 50 wt. %.

Examples of the adhesive contained in the undercoating layer may include known adhesives used for ordinary coated papers, inclusive of: proteins, such as casein and soybean protein; starches, such as starch and oxidized starch; polyvinyl alcohol; cellulose derivatives, such as carboxymethyl cellulose and methyl cellulose; conjugated diene-based polymers, such as styrene-butadiene copolymer, and methyl methacrylate-butadiene copolymer, acrylic polymers, and vinyl polymers, such as ethylene-vinyl acetate copolymer. Some of these polymers may be provided in the form of a latex. These adhesives may be used singly or in combination of plural species. The adhesive may be used in a proportion of 5–50 wt. %, preferably 10–30 wt. %, of the pigment.

In a preferred embodiment of the present invention, a gloss paper is produced through a finishing step wherein the overcoating layer is dry-finished at a temperature below the glass transition point of the polymer principally constituting the cast-coating layer. The drying temperature is not particularly limited with respect to its lower limit but may preferably be at least 40° C., more preferably ca. 50°–90° C.

In a still preferred embodiment, the overcoating or cast-coating layer containing the polymer having a specific glass transition point and formed on the undercoated base paper is dry-finished while being pressed against a cast drum having a mirror-finished surface at a surface temperature below the glass transition point of the polymer. As a result, the cast-coating layer is dry-finished without complete film formation of the polymer, so that the finished cast-coating layer is provided with an excellent gloss while retaining a surface porosity thereof.

On the other hand, if the cast-coating layer (overcoating layer) is dried at a temperature above the glass transition point of the polymer constituting the cast-coating layer (overcoating layer), the polymer is liable to form an intimate film so that the surface porosity of the overcoating layer is hindered, thereby undesirably lowering the ink absorption at the time of ink jet recording. It is particularly undesirable to use a drum surface temperature which exceeds the glass transition point by 20° C. or more.

If the above preferred drying temperature is applied to an overcoating composition containing a polymer having a glass transition point below 40° C., the drying at a still lower temperature results in a very slow drying speed, thus providing a very low productivity.

The undercoating composition may be generally formulated as an aqueous coating composition having a solid concentration of ca. 1–60 wt. % and applied at a dry coating rate of 2–50 g/m$^2$, preferably ca. 5–20 g/m$^2$, onto a base paper having a basis weight of ca. 20–400 g/m$^2$ by known coating means, such as a blade coater, an air knife coater, a roll coater, a brush coater, a Champflex coater, a bar coater, or a gravure coater. After drying, the undercoating layer can be further subjected to a smoothing treatment, such as super-calendering, brushing, or cast-finishing, as desired.

The base paper is not particularly limited with respect to its material but may ordinarily be acidic paper or neutral paper generally used in ordinary coated paper, selectively used as desired. The sizing degree and filler (content) therein may be determined as desired depending on a required printed letter quality. In addition to ordinary paper, it is also possible to use a synthetic paper or unwoven cloth having a good permeability, but ordinary paper is generally preferred.

The thus-undercoated paper is further coated with a cast-coating liquid containing the above-mentioned polymer having a specific glass transition point by a known coating device, such as a blade coater, an air knife coater, a roll coater, a brush coater, a Champflex coater, a bar coater or a gravure coater, thereby to form a wet overcoating layer. Then, the overcoating layer, while in a wet state, is pressed against a heated, mirror-finished drum to be dry-finished. The resultant overcoating or cast-coating layer may be formed in a dry coating rate of 0.2–30 g/m$^2$, preferably 1–10 g/m$^2$.

The cast-coating liquid can further contain optional additives, such as pigments, dispersing agents, thickening agents, deforming agents, colorants, antistatic agents and antiseptics, as used in coating composition for ordinary coated papers and ink jet recording papers, for the purpose of adjusting the whiteness, viscosity, fluidity, etc.

The cast-coating liquid (overcoating may ordinarily be formulated as an aqueous coating composition having a solid content of ca. 10–60 wt. %.

Incidentally, there is also known an ink jet recording paper having a coating layer containing a cationic resin in order to improve the moisture resistance and the image density of the recorded images. If such a cationic resin is added to a conventional cast-coating liquid, the resultant cast coated paper is liable to have a lower surface gloss and a lower ink absorptivity. On the other hand, if a cationic resin is added to an undercoating layer, the resultant cast coated paper can be provided with improved moisture resistance and recorded image density thereon without lowering the surface gloss and ink absorptivity. Further, such a cationic resin contained in the undercoating layer has a function of promoting the agglomeration of the cast-coating composition applied thereon to prevent excessive penetration of the cast-coating liquid, thereby resulting in a cast-coating layer having a uniform and high surface gloss and with little gloss irregularity and fewer pinholes.

Examples of such a cationic resin may include: polyalkylenepolyimines such as polyethylenepolyamine and polypropylenepolyamine, and their derivatives; acrylic resins having a tertiary amine group or a quaternary ammonium group; and diacrylamine.

The cationic resin may be added in a proportion of 1–30 wt. parts, preferably 5–20 wt. parts, per 100 wt. parts of the pigment. Further, it is also possible to add optional additives, such as a dispersing agent, a thickening agent, a defoaming agent, a colorant, an antistatic agent and an antiseptic, as desired, as used in production of ordinary coated papers.

In a particularly preferred embodiment, of the present invention, a copolymer of a polyalkylenepolyamine and and dicyandiamide is used as a preferred cationic resin to be incorporated in the undercoating layer as described above, whereby it is possible to provide a cast coated paper showing excellent moisture resistance and particularly excellent ink jet recording performances which cannot be realized by a conventional cast coated paper, while retaining a high gloss and a high surface smoothness which are intrinsic to cast coated papers.

More specifically, according to this embodiment, there is provided a cast coated paper which comprises, in lamination, a base paper; an undercoating layer comprising a pigment and an adhesive and further containing a cationic resin comprising a copolymer of polyalkylenepolyamine and dicyandiamine; and a cast-coating layer comprising a polymer having a glass transition point of at least 40° C. and formed by polymerization of an ethylenically unsaturated monomer.

The polyalkylenepolyamine constituting the copolymer of polyalkylenepolyamine and dicyandiamine used as a preferred cationic resin in this embodiment may include linear polyamines such as diethylene triamine, triethylenetetramine, tetraethylenepentamine and iminobispropylamine and/or their salts, such as hydrochloric acid salts, sulfuric acid salts or acetic acid salts. Such a polyalkylenepolyamine may be polycondensated with dicyandiamide under heating or in the presence of an aldehyde, such as formaldehyde or acetaldehyde. Further, it is also possible to react a polyalkylenepolyamine with an ammonium salt, such as ammonium chloride, to convert the polyalkylenepolyamine into its salt, such as a chloride, and then subject the salt to polycondensation with dicyandiamide. Such a product may be referred to, e.g., as polyalkylenepolyamide-dicyandiamide-ammonium salt polycondensate. It is further possible to copolymerize another component within an extent not substantially adversely affecting the function of the polyalkylenepolyamine-dicyandiamide copolymer.

The copolymer of such a polyalkylenepolyamine and dicyandiamide provides a cast coated paper having a better water resistance and a better gloss after the cast-finishing than a cast coated paper using another cationic resin, such as an acrylic resin having a tertiary amino group or a tertiary or quaternary ammonium group, or acrylamine conventionally used in production of ink jet recording papers.

The thus-prepared cast coated paper or gloss paper may be used in the ink jet recording method according to the present invention, wherein an ink is released or ejected from a nozzle or orifice onto the paper as an objective recording medium according to any effective scheme. A particular effective example of such an ink jet recording scheme may be one as disclosed in Japanese Laid-Open Patent Application (JP-A) 54-59936 wherein an ink is supplied with a thermal energy to cause an abrupt volume change and is ejected out of a nozzle under the action of the volume change.

Figure 2:
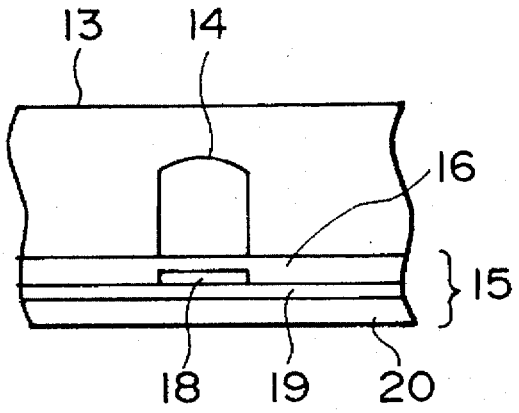
FIG. 2 is a cross-sectional view taken along a line A–B shown in FIG. 1.
Figure 3:
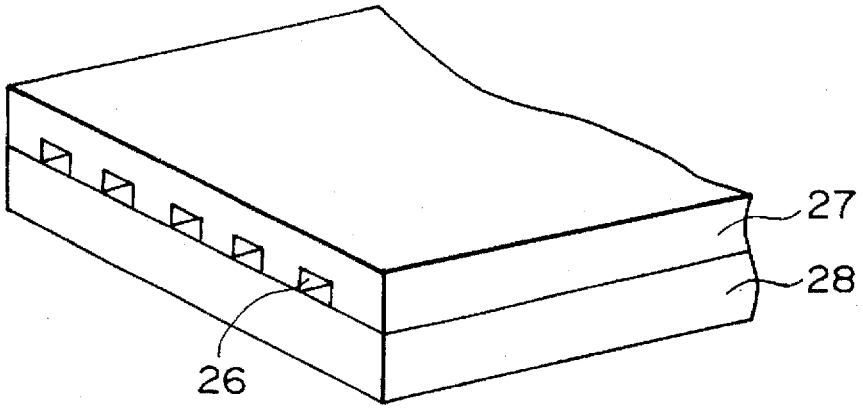
FIG. 3 is a partial perspective view of a multiple recording head including the head shown in FIGS. 1 and 2.
Figure 4:
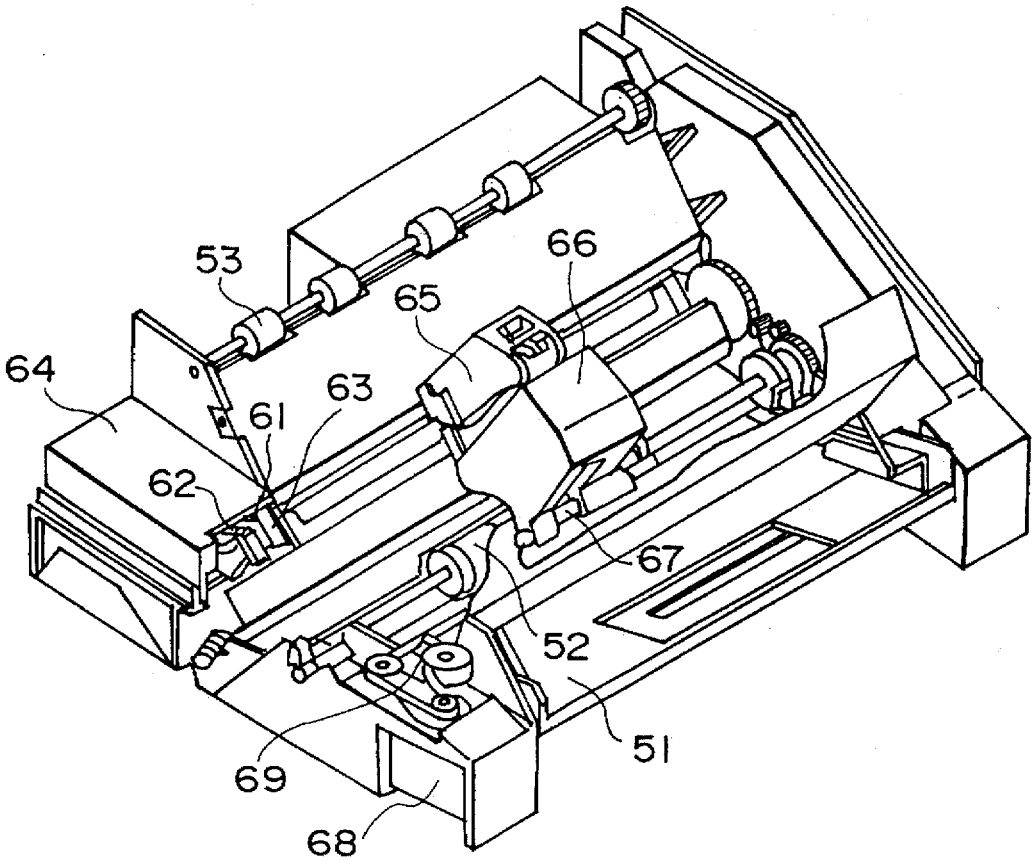
FIG. 4 is perspective view of an example of an ink jet recording apparatus.

Next, a description will be made about a recording apparatus which is suitably used in the ink jet recording method based on FIGS. 1–3 showing a structure of an ink election nozzle head and FIG. 4 showing an entire structure of the apparatus including the head.

FIG. 1 is a sectional view of a head 13 along an ink passage. FIG. 2 is a sectional view taken along the lane A–B of FIG. 1. Referring to FIGS. 1 and 2, a head 13 is obtained by bonding a glass, ceramic or plastic plate having a groove 14 which forms an ink passage to a heat generating head 15 (although a head is shown as a heat generating means in the figure, it is not limited), having a heat generating resistive member, for use in thermal recording. The heat generating head 15 is composed of a protective film 16 formed of silicon oxide, aluminum electrodes 17-1 and 17-2, a heat-generating resistive layer 18 formed of nichrome or the like, a heat storage layer 19, and a substrate 20 having good heat dissipating property, such as alumina.

Recording ink 21 reaches a discharge orifice (micropore) 22, and forms a meniscus 23 by a pressure P. At this point, when an electrical signal is applied to the aluminum electrodes 17-1 and 17-2, the region indicated by n of the heat generating head 15 suddenly generates heat; air bubbles are generated in the ink 21 in contact with this region; the meniscus is discharged by that pressure; the droplets are formed into recording droplets 24 through the orifice 22, and jetted toward a recording member 25. FIG. 3 is a schematic perspective view of a recording head in which a number of nozzles shown in FIGS. 1 and 2 are arranged. The recording head is manufactured by bringing a glass sheet 27 having a number of passages 26 into close contact with a heat generating head 28 having the same construction as that explained with reference to FIG. 1.

FIG. 4 illustrates an example of an ink jet recording apparatus into which the head is incorporated.

In FIG. 4, reference numeral 61 denotes a blade serving as a wiping member, one end of which is held by a blade holding member and formed into a fixed end, forming a cantilever. The blade 61 is arranged at a position adjacent to the recording region by the recording head. In this example, the blade 61 is held in a position such that it projects in the path of the movement of the recording head. Reference numeral 62 denotes a cap which is disposed at a home position adjacent to the blade 61 and is moved in a direction perpendicular to the direction in which the recording head is moved, and brought into contact with the surface of the discharge port so that capping is performed. Reference numeral 63 denotes an ink absorber disposed adjacent to the blade 61, and is held in such a manner as to protrude into the path of movement passage of the recording head in the same manner as the blade 61. The blade 61, the cap 62 and the ink absorber 63 constitute a discharge recovery section 64. Water, dust or the like is removed to the ink discharge port surface by means of the blade 61 and the absorber 63.

Reference numeral 65 denotes a recording head, having a discharge energy generating means, for performing recording by discharging ink onto a recording member facing the discharge port surface where the discharge port is arranged; and reference numeral 66 denotes a carriage having the recording head 65 installed therein, by which the recording head 65 is moved. The carriage 66 engages pivotally with a guide shaft 67, and a part of the carriage 66 is connected to a belt 59 (in a manner not shown) which is driven by a motor 68. As a result, the carriage 66 is allowed to move along the guide shaft 67 and move in the region of recording by the recording head 65 and the region adjacent thereto.

Reference numeral 51 denotes a paper feeding part for inserting recording papers, and reference numeral 52 denotes a paper feeding roller which is driven by a roller (not shown). This arrangement allows the recording paper to be fed to a position opposite the ejection outlet of the recording head and to be delivered to a take-off part having a take-off roller 53 as the recording proceeds.

In the above-mentioned arrangement, when the recording head 65 is returned to the home position at the end of recording, the head 62 in the head recovery part 64 is retracted from the movement path of the recording head 65, while the blade 61 is projected in the movement path. As a result, the ejection outlet surface of the recording head 61 is wiped by the blade 61. When the cap 62 contacts the ejection outlet surface of the recording head so as to cap it, the cap 62 is moved so as to project in the movement path of the recording head 65.

When the recording head 65 is moved from the home position to the recording start position, the cap 62 and the blade 61 are at the same positions as in the wiping operation. As a result, the ejection outlet surface of the recording head 65 is also wiped during the movement thereof.

The recording head 65 is moved to the home position adjacent to the recording region not only at the end of recording and recovery of discharging (the operation of sucking an ink from the ejection outlet in order to recover the normal discharge of an ink from the ejection outlet), but also at predetermined intervals when it is moved in the recording region for recording. This movement also causes the above-described wiping.

The ink used in the ink jet recording method of the present invention comprises, as essential components, a colorant for forming images and a liquid medium for dissolving or dispersing the colorant therein, and may further contain optional additives, such as dispersing agent, surfactant, viscosity modifier, resistivity-adjusting agent, pH-adjusting agent, antiseptic, and colorant-dissolution or dispersion stabilizer, as desired.

The colorant or recording agent used in the ink may comprise direct dye, acid dye, basic dye, reactive dye, food dye, disperse dye, oil dye or various pigment, but any of known colorants can be used without particular restriction. The colorant may be contained in a quantity determined depending on the liquid medium used and the properties required of the ink but may be used in a conventional proportion, i.e., ca. 0.1–20 wt. %, without particular problem.

The ink used in the present invention comprises a liquid medium for dissolving or dispersing the colorant therein, which medium may suitably comprise water or a mixture of water and a water-miscible organic solvent, such as a polyhydric alcohol capable of preventing the drying of the ink.

[EXAMPLES]

Hereinbelow, the present invention will be described more specifically based on Examples, which however should not be construed as limitative. In the Examples, "%" and "parts" are by weight unless otherwise noted specifically. Unless otherwise noted specifically, the germ "part(s)" is used to express weight ratios among the components except for water.

The air permeability of a product coated paper described herein refers to a value measured according to JIS-P-8117 and expressed in the unit of sec/100 cc, and the (Gurley) air permeability of an undercoated base paper refers to a value measured according to ASTM-D-726 B-method by using a Gurley high pressure-type air permeability tester and expressed in the unit of sec/10 cc, respectively unless otherwise noted specifically.

The experimental Examples described hereinafter were performed in Series of I, II and respectively.

The printability (recording performance) evaluation in Series I and II was performed by forming images with inks in four colors of magenta, cyan, black and yellow and evaluating the ink absorptivity and image density of the respective monocolor solid printed parts of four colors by visual observation. The results are respectively indicated by an average of the evaluation results with respect to the four monocolor images.

The printability (recording performance) evaluation in Series III was performed by forming images in four colors of magenta, cyan, black and yellow in superposition, and the ink absorptivity and image density of the superposed color images were evaluated by visual observation.

The evaluation in Series I, II and III were performed based on a relative standard for each series.

EXAMPLE I-1

An aqueous undercoating liquid having a solid content of 20% was prepared by using 100 parts of amorphous silica (pigment), 20 parts of polyvinyl alcohol (adhesive), 5 parts of acrylic resin containing quaternary ammonium salt (cationic agent) and 0.5 part of sodium polyphosphate (dispersing agent). The undercoating liquid was applied at a dry coating rate of 10 g/m$^2$ by an air knife coater onto a base paper having a basis weight of 100 g/m$^2$, followed by drying to prepare an undercoated base paper (i.e., a base paper provided with an undercoating layer). The undercoated base paper showed a Gurley air permeability of 5 sec/10 cc.

On the other had, a cast-coating liquid having a solid content of 40% was prepared by using 100 parts of styrene-2-methylhexyl acrylate copolymer having a glass transition point (Tg) of 80° C. and 10 parts of calcium stearate (release agent). The cast-coating liquid was applied by a roll coater onto the undercoated base paper to form a wet overcoating or cast-coating layer, which was immediately thereafter pressed against a mirror-finished drum having a surface temperature of 75° C. to be dried, followed by releasing, to form a east coated paper for ink jet recording. The cast-coating rate (solid) was 5 g/m$^2$.

EXAMPLE I-2

A cast-coating liquid having a solid content of 40% was prepared by using 100 parts of styrene-methyl acrylate copolymer (Tg=70° C.)/colloidal silica composite (weight ratio=50/50) and 10 parts of calcium stearate (release agent). The cast-coating liquid was applied by a roll coater onto an undercoated base paper identical to the one prepared in Example I-1 to form a wet cast-coating layer, which was immediately thereafter pressed against a mirror-finished drum having a surface temperature of 60° C. to be dried, followed by releasing, to obtain a cast coated paper for ink jet recording. The cast-coating rate (solid) was 2 g/m$^2$.

EXAMPLE I-3

An cast coated paper for ink jet recording was prepared in the same manner as in Example I-1 except that the surface temperature of the mirror-finished drum was changed to 50° C.

EXAMPLE I-4

A cast-coating liquid having a solid content of 40% was prepared by using 100 parts of acrylate polymer (Tg=45° C.)

and 5 parts of calcium stearate (release agent). The cast-coating liquid was applied by a roll coater onto an undercoated base paper identical to the one prepared in Example I-1 to form a wet cast-coating layer, which was immediately thereafter pressed against a mirror-finished drum having a surface temperature of 40° C. to be dried, followed by releasing, to obtain a cast coated paper for ink jet recording. The cast-coating rate (solid) was 3 g/m$^2$.

EXAMPLE I-5

A cast-coating liquid having a solid content of 35% was prepared by using 100 parts of styrene-methyl acrylate copolymer (Tg=95° C.)/colloidal silica composite and 5 parts of ammonium oleate (release agent). The cast-coating liquid was applied by a roll coater onto an undercoated base paper identical to the one prepared in Example I-1 to form a wet cast-coating layer, which was immediately thereafter pressed against a mirror-finished drum having a surface temperature of 90° C. to be dried, followed by releasing, to obtain a cash coated paper for ink jet recording. The cast-coating rate (solid) was 2 g/m$^2$.

EXAMPLE I-6

An undercoating liquid having a solid content of 55% was prepared by using 40 parts of kaolin (pigment), 30 parts of light calcium carbonate (pigment), 30 parts of heavy calcium carbonate (pigment), 5 parts of starch (adhesive), 10 parts (solid) of styrene-butadiene copolymer latex (adhesive), 5 parts of acrylic resin containing quaternary ammonium salt (cationic resin) and 0.5 part of sodium polyphosphate (dispersing agent). The undercoating liquid was applied at a dry coating rate of 20 g/m$^2$ by a blade coater onto a base paper having a basis weight of 60 g/m$^2$, followed by drying, to obtain an undercoated base paper. The undercoated base paper showed a Gurley air permeability of 50 sec/10 cc.

A cast-coating liquid identical to the one used in Example I-1 was applied onto the above undercoated base paper, followed by drying, in the same manner as in Example I-1 to prepare a cast coated paper for ink jet recording.

EXAMPLE I-7

A cast coated paper for ink jet recording was prepared in the same manner as in Example I-1 except that the surface temperature of the mirror-finished drum was changed to 90° C.

EXAMPLE I-8

A cast coated paper for ink jet recording was prepared in the same manner as in Example I-2 except that the surface temperature of the mirror-finished drum was changed to 80° C.

Comparative Example I-1

A cast-coating liquid having a solid content of 40% was prepared by using 100 parts of styrene-butadiene copolymer (Tg=0° C.) and 10 parts of calcium stearate (release agent). The cast-coating liquid was applied by a roll coater onto an undercoated base paper identical to the one prepared in Example I-1 to form a wet cast-coating layer, which was immediately thereafter pressed against a mirror-finished drum having a surface temperature of 60° C. to be dried, followed by releasing, to obtain a cast coated paper for ink jet recording. The cast-coating rate (solid) was 2 g/m$^2$.

Comparative Example I-2

An undercoating liquid having a solid content of 60% was prepared by using 50 parts of kaolin (pigment), 50 parts of heavy calcium carbonate (pigment), 5 parts of oxidized starch (adhesive), 12 parts (solid) of styrene-butadiene copolymer latex (adhesive), and 0.5 part of polysodium acrylate (dispersing agent). The undercoating liquid was applied at a dry coating rate of 20 g/m$^2$ by a blade confer onto a base paper having a basis weight of 60 g/m$^2$, followed by drying, to obtain an undercoated base paper. The undercoated base paper showed a Gurley air permeability of 100 see/10 cc.

Separately, a cast-coating liquid having a solid content of 45% was prepared by using 100 parts of kaolin, 10 parts of casein, 10 parts of styrene-butadiene copolymer (Tg=10° C.) and 10 parts of calcium stearate (release agent). The cast-coating liquid was applied by a roll coater onto the above-prepared undercoated base paper to form a wet cast-coating layer, which was immediately thereafter pressed against a mirror-finished drum having a surface temperature of 75° C. to be dried, followed by releasing, to obtain a cast coated paper for ink jet recording. The cast-coating rate (solid) was 15 g/m$^2$.

The gloss (in as-produced state), printability (ink jet recording performance) and the operability in production of the above-prepared cast coated papers were evaluated in the following manner and the results are shown in Table I appearing hereinafter.

[Gloss]

Measured according to JIS-P8142.

[Ink absorptivity/ink jet recording performance]

Printing was performed on each cast coated paper by using a commercially available ink jet printer ("Color Image Jet IO-735X", mfd. by Sharp K.K.). and the dryness of the printed ink images was evaluated by touch and visually according to the following standards.

⊙: No soiling by touching with fingers immediately after printing.

○: A slight degree of soiling was observed by touching with fingers, but almost dry, immediately after printing.

Δ: The printed image part was shiny immediately after printing, but practically acceptable.

x: The ink flowed during printing due to poor drying of the ink, thus being practically unacceptable.

[Casting Operability]

○: Operated without problem

Δ: A low-speed operation was required but practically acceptable.

x: Picking onto the drum occurred due to poor releasability.

TABLE 1

| | Gloss (%) | Ink aborptivity | Casting operativity |
|---|---|---|---|
| Example | | | |
| I-1 | 85 | ⊙ | ○ |
| I-2 | 80 | ⊙ | ○ |
| I-3 | 78 | ⊙ | ○ |
| I-4 | 78 | ○ | Δ |
| I-5 | 75 | ⊙ | ○ |
| I-6 | 84 | Δ | ○ |
| I-7 | 89 | Δ | Δ |
| I-8 | 87 | Δ | Δ |

TABLE 1-continued

| Comp. Example | Gloss (%) | Ink aborptivity | Casting operativity |
|---|---|---|---|
| I-1 | 90 | x | x |
| I-2 | 89 | x | o |

EXAMPLE II-1

An undercoating liquid having a solid content of 15% was prepared by using 90 parts of amorphous silica (pigment), 10 parts of light calcium carbonate (pigment), 20 parts of polyvinyl alcohol (adhesive), 10 parts of a condensation product between dicyandiamide and formalin (cationic resin; "NEOFIX FY" (trade name), made by Nikka Kagaku Kogyo K.K.) and 0.5 part of sodium polyphosphate (dispersing agent). The undercoating liquid was applied at a dry coating rate of 12 g/m$^2$ by an air knife coater onto a base paper having a basis weight of 100 g/m$^2$ to prepare an undercoated bale paper, which showed a Gurley air permeability of 4 sec/10 cc.

On the other hand, a cast-coating liquid having a solid content of 30% was prepared by using 40 parts of styrene-2-methylhexyl acrylate copolymer having a glass transition point (Tg) of 80° C., 60 parts of colloidal silica and 2 parts of calcium stearate (release agent). The cast-coating liquid was applied by a roll coater onto the above-prepared undercoated base paper to form a wet cast-coating layer, which was immediately thereafter pressed against a mirror-finished drum having a surface temperature of 85° C. to be dried, followed by releasing, to form a cast coating paper for ink jet recording. The coating rate (solid) at this time was 5 g/m$^2$. The cast coated paper showed an air permeability (according to JIS-P-8117) of 120 sec/100 cc.

EXAMPLE II-2

An cast coated paper for ink jet recording was prepared in the same manner as in Example II-1 except that the surface temperature of the mirror-finished drum was changed to 70° C. from 85° C. The cast coated paper showed an air permeability of 80 sec/100 cc.

EXAMPLE II-3

A cast-coating liquid having a solid content of 35% was prepared by using 100 parts of styrene-methyl acrylate copolymer (Tg=50° C.) and 10 parts of ammonium oleate (release agent). The cast-coating liquid was applied by a roll coater onto an undercoated base paper identical to the one prepared in Example II-1 to form a wet cast-coating layer, which was immediately thereafter pressed against a mirror-finished drum having a surface temperature of 60° C. to be dried, followed by releasing, to obtain a cast coated paper for ink jet recording. The cast-coating rate (solid) was 1 g/m$^2$. The cast coated paper showed an air permeability of 100 sec/100 cc.

EXAMPLE II-4

A cast-coating liquid having a solid content of 40% was prepared by using 100 parts of styrene-methyl acrylate copolymer (Tg=70° C.)/colloidal silica composite and 3 parts of ammonium oleate (release agent). The cast-coating liquid was applied by a roll coater onto an undercoated base paper identical to the one prepared in Example II-1 to form a wet cast-coating layer, which was immediately thereafter pressed against a mirror-finished drum having a surface temperature of 65° C. to be dried, followed by releasing, to obtain a cast coated paper for ink jet recording. The cast-coating rate (solid) was 6 g/m$^2$. The cast coated paper showed an air permeability of 75 sec/100 cc.

EXAMPLE II-5

An undercoating liquid having a solid content of 30% was prepared by using 70 parts of $MgCO_3$ (pigment), 30 parts of heavy calcium carbonate (pigment), 10 parts (solid) of styrene-butadiene copolymer latex (adhesive), 5 parts of a condensation product between dicyandiamide and formalin (cationic resin; "NEOFIX FY" (trade name), made by Nikka Kagaku Kogyo K.K.) and 0.4 part of sodium polyphosphate (dispersing agent). The undercoating liquid was applied at a dry coating rate of 15 g/m$^2$ by a blade coater onto a base paper having a basis weight of 60 g/m$^2$ to prepare an undercoated base paper, which showed a Gurley air permeability of 10 sec/10 cc.

Then, onto the undercoated base paper, the cast-coating liquid prepared in Example II-1 was applied and cast-finished in the same manner as in Example II-1 to form a cast coated paper for ink jet recording. The cast coated paper showed an air permeability of 220 sec/100 cc.

EXAMPLE II-6

An undercoating liquid having a solid content of 30% was prepared by using 70 parts of $Al_2O_3$ (pigment), 30 parts of amorphous silica (pigment), 15 parts of polyvinyl alcohol (adhesive), 8 parts of polyethylenepolyamine-based resin (cationic resin; "NEOFIX RP-70" (trade name), made by Nikka Kagaku Kogyo K.K.) and 0.4 part of sodium polyphosphate (dispersing agent). The undercoating liquid was applied at a dry coating rate of 9 g/m$^2$ by a blade coater onto a base paper having a basis weight of 80 g/m$^2$ to prepare an undercoated base paper, which showed a Gurley air permeability of 7 sec/10 cc.

Then, onto the undercoated base paper, the cast-coating liquid prepared in Example II-1 was applied and cast-finished in the same manner as in Example II-1 to form a cast coated paper for ink jet recording. The cast coated paper showed an air permeability of 250 sec/100 cc.

EXAMPLE II-7

An undercoating liquid having a solid content of 30% was prepared by using 80 parts of MgO (pigment), 20 parts of kaolin (pigment), 19 parts of polyvinyl alcohol (adhesive), 8 parts of diacrylamineacrylamide-based resin (cationic resin; "SUMIRAEZ RESIN 1001" (trade name), made by Sumitomo Kagaku Kogyo K.K. ) and 0.4 part of sodium polyphosphate (dispersing agent). The undercoating liquid was applied at a dry coating rate of 14 g/m$^2$ by a blade coater onto a base paper having a basis weight of 80 g/m$^2$ to prepare an undercoated base paper, which showed a Gurley air permeability of 7 sec/10 cc.

Then, onto the undercoated base paper, the cast-coating liquid prepared in Example II-1 was applied and cast-finished in the see manner as in Example II-1 to form a cast coated paper for ink jet recording. The cast coated paper showed an air permeability of 180 sec/100 cc.

EXAMPLE II-8

An undercoating liquid having a solid content of 20% was prepared by using 80 parts of aluminum oxide, 20 parts of amorphous silica, 15 parts of polyvinyl alcohol and 0.5 part of sodium polyphosphate. The undercoating liquid was applied at a dry coating rate of 12 g/m$^2$ by an air knife coater onto a base paper having a basis weight of 100 g/m$^2$ to prepare an undercoated base paper, which showed a Gurley air permeability of 15 sec/10 cc.

On the other hand, a cast-coating liquid having a solid content of 30% was prepared by using 50 parts of styrene-2-methylhexyl acrylate copolymer having a glass transition point (Tg) of 80° C., 50 parts of colloidal silica and 2 parts of calcium stearate (release agent). The cast-coating liquid was applied by a roll coater onto the above-prepared undercoated base paper to form a wet cast-coating layer, which was immediately thereafter pressed against a mirror-finished drum having a surface temperature of 85° C. to be dried, followed by releasing, to form a cast coating paper for ink jet recording. The coating rate (solid) at this time was 6 g/m$^2$. The cast coated paper showed an air permeability of 400 sec/100 cc.

EXAMPLE II-9

An undercoating liquid having a solid content of 15% was prepared by using 100 parts of amorphous silica (pigment), 15 parts of polyvinyl alcohol (adhesive), and 1.0 part of sodium polyphosphate (dispersing agent). The undercoating liquid was applied at a dry coating rate of 6 g/m$^2$ by an air knife coater onto a base paper having a basis weight of 100 g/m$^2$ to prepare an undercoated base paper, which showed a Gurley air permeability of 4 sec/10 cc.

On the other hand, a cast-coating liquid having a solid content of 30% was prepared by using 50 parts of styrene-2-methylhexyl acrylate copolymer having a glass transition point (Tg) of 80° C., 50 parts of colloidal silica and 2 parts of calcium stearate (release agent). The cast-coating liquid was applied by a roll coater onto the above-prepared undercoated base paper to form a wet cast-coating layer, which was immediately thereafter pressed against a mirror-finished drum having a surface temperature of 85° C. to be dried, followed by releasing, to form a cast coating paper for ink jet recording. The coating rate (solid) at this time was 6 g/m$^2$. The cast coated paper showed an air permeability of 100 sec/100 cc.

Comparative Example II-1

A cast-coating liquid having a solid content of 35% was prepared by using 40 parts of styrene-2-methylhexyl acrylate copolymer (Tg=0° C.), 60 parts of colloidal silica and 5 parts of ammonium oleate (release agent). The cast-coating liquid was applied by a roll coater onto an undercoated base paper identical to the one prepared in Example II-1 to form a wet cast-coating layer, which was immediately thereafter pressed against a mirror-finished drum having a surface temperature of 60° C. to be dried, followed by releasing, to form a cast coated paper for ink jet recording. The coating rate (solid) at this time was 5 g/m$^2$. The cask coated paper showed an air permeability of 450 sec/100 cc.

Comparative Example II-2

A cast-coating liquid having a solid content of 35% was prepared by using 100 parts of styrene-butadiene copolymer (Tg=30° C.), and 5 parts of ammonium oleate (release agent). The cast-coating liquid was applied by a roll coater onto an undercoated base paper identical to the one prepared in Example II-1 to form a wet cast-coating layer, which was immediately thereafter pressed against a mirror-finished drum having a surface temperature of 80° C. to be dried, followed by releasing, to form a cast coated paper for ink jet recording. The coating rate (solid) at this time was 5 g/m$^2$. The cast coated paper showed an air permeability of 1300 sec/100 cc.

Comparative Example II-3

A cast-coating liquid having a solid content of 35% was prepared by using 100 parts of styrene-butadiene copolymer (Tg=0° C.), and 5 parts of ammonium oleate (release agent). The cast-coating liquid was applied by a roll coater onto an undercoated base paper identical to the one prepared in Example II-1 to form a wet cast-coating layer, which was immediately thereafter pressed against a mirror-finished drum having a surface temperature of 60° C. to be dried, followed by releasing, to form a cast coated paper for ink jet recording. The coating rate (solid) at this time was 5 g/m$^2$. The cast coated paper showed an air permeability of 2200 sec/100 cc.

Comparative Example II-4

A cast-coating liquid having a solid content of 45% was prepared by using 100 parts of kaolin, 10 parts of casein, 10 parts of styrene-methyl methacrylate copolymer (Tg=30° C.) and 10 parts of calcium stearate (release agent). The cast-coating liquid was applied by a roll coater onto an undercoated base paper identical to the one prepared in Example II-1 to form a wet cast-coating layer, which was immediately thereafter pressed against a mirror-finished drum having a surface temperature of 75° C. to be dried, followed by releasing, to form a cast coated paper for ink jet recording. The coating rate (solid) at this time was 15 g/m$^2$. The cast coated paper showed an air permeability of 5000 sec/100 cc.

Comparative Example II-5

An undercoating liquid having a solid content of 50% was prepared by using 50 parts of kaolin (pigment), 50 parts of light calcium carbonate (pigment), 5 parts of oxidized starch (adhesive), 20 parts (solid) of styrene-butadiene copolymer latex and 0.5 part of sodium polyphosphate (dispersing agent). The undercoating liquid was applied at a dry coating rate of 12 g/m$^2$ by an air knife coater onto a base paper having a basis weight of 100 g/m$^2$ to prepare an undercoated base paper, which showed a Gurley air permeability of 200 sec/10 cc.

Then, onto the undercoated base paper, the cast-coating liquid prepared in Comparative Example II-4 was applied to form a wet cast-coating layer, which was immediately thereafter pressed against a mirror-finished drum having a surface temperature of 85° C. to be dried, followed by releasing, to form a cast coating paper for ink jet recording. The coating rate (solid) at this time was 15 g/m$^2$. The cast coated paper showed an air permeability of 10000 sec/100 cc.

The gloss (in as-produced state), ink jet recording performances (inclusive of ink absorptivity and recorded image density) and the operability in production of the above-prepared cast coated papers were evaluated in the following manner and are shown in Table 2 appearing hereinafter.

[Gloss]

Measured according to JIS-P8142.

[Ink Absorptivity]

Printing was performed on each cast coated paper by using a commercially available ink jet printer ("Color Image Jet IO-735X", mfd. by Sharp K.K.), and the dryness of the printed ink images was evaluated by touch and visually according to the following standards.

⊙: No soiling at all by touching with fingers immediately after printing.

○: A slight degree of soiling was observed by touching with fingers, but almost dry, immediately after printing.

Δ: The printed image part was shiny immediately after printing, but practically acceptable.

ΔΔ: The printed image part was shiny immediately after printing but was dried ca. 10 sec later, and accordingly practically acceptable for image patterns with a small ink coverage.

x: The ink flowed during printing due to poor drying of the ink, thus being practically unacceptable.

[Recorded Image Density]

After the above printing, the image density of the recorded images was evaluated visually according to the following standards:

○: Sufficient image density.

Δ: The image density was somewhat low but at a practically acceptable level.

x: The image density was low and practically unacceptable.

[Casting Operability]

○: Operated without problem

Δ: A low-speed operation was required but practically acceptable.

x: Picking onto the drum occurred due to poor releasability, thus being practically inoperable.

TABLE 2

| | | Recording performances | | |
|---|---|---|---|---|
| | Gloss (%) | Ink absortivity | Image density | Operability |
| Example | | | | |
| II-1 | 89 | ○ | ○ | ○ |
| II-2 | 89 | ⊙ | ○ | ○ |
| II-3 | 87 | ○ | ○ | ○ |
| II-4 | 89 | ⊙ | ○ | ○ |
| II-5 | 86 | Δ | ○ | ○ |
| II-6 | 85 | Δ | Δ | ○ |
| II-7 | 85 | ○ | Δ | ○ |
| II-8 | 79 | ΔΔ | Δ | ○ |
| II-9 | 84 | ○ | Δ | ○ |
| Comp. Example | | | | |
| II-1 | 92 | x | x | x |
| II-2 | 92 | x | Δ | x |
| II-3 | 92 | x | Δ | x |
| II-4 | 55 | x | x | ○ |
| II-5 | 90 | x | Δ | ○ |

EXAMPLE III-1

An undercoating liquid having a solid content of 15% was prepared by using 100 parts of amorphous silica (pigment), 20 parts of polyvinyl alcohol (adhesive), 5 parts of a polyethylenepolyamine-dicyandiamide-ammonium salt polycondensation product (cationic resin; "PNF-70" (trade name), made by Nikka Kagaku Kogyo K.K.) and 0.5 part of sodium polyphosphate (dispersing agent). The undercoating liquid was applied at a dry coating rate of 10 g/m$^2$ by an air knife coater onto a base paper having a basis weight of 100 g/m$^2$ to prepare an undercoated base paper, which showed a Gurley air permeability of 4 sec/10 cc.

On the other hand, a cast-coating liquid having a solid content of 35% was prepared by using 50 parts of styrene-2-methylhexyl acrylate copolymer having a glass transition point (Tg) of 80° C., 50 parts of colloidal silica and 2 parts of calcium stearate (release agent). The cast-coating liquid was applied by a roll coater onto the above-prepared undercoated base paper to form a wet cast-coating layer, which was immediately thereafter pressed against a mirror-finished drum having a surface temperature of 75° C. to be dried, followed by releasing, to form a cast coated paper for ink jet recording. The coating rate (solid) at this time was 5 g/m$^2$. The cast coated paper showed an air permeability (according to JIS-P-8117) of 50 sec/100 cc.

EXAMPLE III-2

A cast-coating liquid having a solid content of 40% was prepared by using 100 parts of styrene-methyl acrylate copolymer (Tg=70° C.)/colloidal silica composite and 3 parts of ammonium oleate (release agent). The cast-coating liquid was applied by a roll coater onto an undercoated base paper identical to the one prepared in Example III-1 to form a wet cast-coating layer, which was immediately thereafter pressed against a mirror-finished drum having a surface temperature of 65° C. to be dried, followed by releasing, to obtain a cast coated paper for ink jet recording. The cast-coating rate (solid) was 6 g/m$^2$. The cast coated paper showed an air permeability of 60 sec/100 cc.

EXAMPLE III-3

A cast-coating liquid having a solid content of 35% was prepared by using 100 parts of styrene-methyl acrylate copolymer (Tg=50° C.) and 5 parts of ammonium oleate (release agent). The cast-coating liquid was applied by a roll coater onto an undercoated base paper identical to the one prepared in Example III-1 to form a wet cast-coating layer, which was immediately thereafter pressed against a mirror-finished drum having a surface temperature of 50° C. to be dried, followed by releasing to obtain a cast coated paper for ink jet recording. The cast-coating rate (solid) was 1 g/m$^2$. The cast coated polymer showed an air permeability of 80 sec/100 cc.

EXAMPLE III-4

An undercoating liquid having a solid content of 15% was prepared by using 100 parts of amorphous silica (pigment), 10 parts of polyvinyl alcohol (adhesive), 10 parts of a polycondensation product between dicyandiamide and polyalkylenepolyamine (ca, ionic resin; "NEOFIX E-117" (trade name), made by Nikka Kagaku Kogyo K.K.) and 0.5 part of sodium polyphosphate (dispersing agent). The undercoating liquid was applied at a dry coating rate of 5 g/m$^2$ by an air knife coater onto a base paper having a basis weight of 100 g/m$^2$ to prepare an undercoated base paper, which showed a Gurley air permeability of 4 sec/10 cc.

On the other hand, a cast-coating liquid having a solid content of 35% was prepared by using 50 parts of styrene-2-methylhexyl acrylate copolymer (Tg=80° C.), 50 parts of colloidal silica and 2 parts of calcium stearate (release agent). The cast-coating liquid was applied by a roll coater onto the above-prepared undercoated base paper to form a wet cast-coating layer, which was immediately thereafter pressed against a mirror-finished drum having a surface temperature of 75° C. to be dried, followed by releasing, to form a cast coated paper for ink jet recording. The coating rate (solid) at this time was 5 g/m$^2$. The cast coated paper showed an air permeability of 50 sec/100 cc.

EXAMPLE III-5

A cast coated paper for ink jet recording was prepared in the same manner as in Example III-1 except that the carbonic resin in the undercoating liquid was replaced by polyalkanolallylamine.

The undercoated base paper showed a Gurley air permeability of 4 sec/10 cc. The cast coated polymer showed an air permeability of 50 sec/100 cc.

EXAMPLE III-6

A cast coated paper for ink jet recording was prepared in the same manner as in Example III-2 except that the cationic resin in the undercoating liquid was replaced by dimethyidiallylammonium chloride polymer.

The undercoated base paper showed a Gurley air permeability of 3 sec/10 cc. The cast coated polymer showed an air permeability of 55 sec/100 cc.

EXAMPLE III-7

A cast coated paper for ink jet recording was prepared in the same manner as in Example III-1 except that the cationic resin was omitted from the undercoating liquid.

The undercoated base paper showed a Gurley air permeability of 2 sec/10 cc. The cast coated polymer showed an air permeability of 60 sec/100 cc.

Comparative Example III-1

A cast-coating liquid having a solid content of 35% was prepared by using 100 parts of styrene-butadiene copolymer (Tg=0° C.) and 5 parts of ammonium oleate (release agent). The cast-coating liquid was applied by a roll coater onto an undercoated base paper identical to the one prepared in Example III-1 to form a wet cast-coating layer, which was immediately thereafter pressed against a mirror-finished drum having a surface temperature of 60° C. to be dried, followed by releasing, to form a cast coated paper for ink jet recording. The coating rate (solid) at this time was 5 g/m$^2$. The cast coated paper showed an air permeability of 320 sec/100 cc.

Comparative Example III-2

A cast-coating liquid having a solid content of 45% was prepared by using 100 parts of kaolin, 10 parts of casein, 10 parts of styrene-methyl methacrylate copolymer (Tg=30° C.), and 10 parts of calcium stearate (release agent). The cast-coating liquid was applied by a roll coater onto an undercoated base paper identical to the one prepared in Example III-1 to form a wet cast-coating layer, which was immediately thereafter pressed against a mirror-finished drum having a surface temperature of 75° C. to be dried, followed by releasing, to form a cast coated paper for ink jet recording. The coating rate (solid) at this time was 15 g/m$^2$. The cast coated paper showed an air permeability of 1500 sec/100 cc.

The gloss (in as-produced state), ink jet recording performances (inclusive of ink absorptivity, recorded image density and recorded image water resistance) and the operability in production of the above-prepared cast coated papers were evaluated in the following manner and are shown in Table 3 appearing hereinafter.

[Gloss ]

Measured according to JIS-P8142.

[Ink Absorptivity]

Printing was performed on each cast coated paper by using a commercially available ink jet printer ("Color Image Jet IO-735X", mfd. by Sharp K.K.), and the dryness of the printed ink images was evaluated by touch and visually according to the following standards.

⊙: No soiling at all by touching with fingers immediately after printing.

o: A slight degree of soiling was observed by touching with fingers, but almost dry, immediately after printing.

Δ: The printed image part was shiny immediately after printing, but practically acceptable.

x: The ink flowed during printing due to poor drying of the ink, thus being practically unacceptable.

[Recorded Image Density]

After the above printing, the image density of the recorded images was evaluated visually according to the following standards:

o: Very excellent image density.

Δ: Good image density.

x: The image density was low and practically unacceptable.

[Water Resistance of Recorded Image]

After the above printing, the paper carrying the recorded image was dipped in water for ca. 10 min., and then the recorded image after the dipping was evaluated by visual observation according to the following standards.

o: The recorded image was not flown or blurred with water.

Δ: The recorded image had a tendency of slightly blurred but practically acceptable.

x: The recorded image was flown and blurred with water.

[Casting Operability]

o: Operated without problem

Δ: A low-speed operation was required but practically acceptable.

x: Picking onto the drum occurred due to poor releasability, thus being practically inoperable.

Further, the cast coated paper according to the present invention was found to show very excellent recording performances when used in an ink jet recording apparatus wherein an aqueous ink was imparted with a thermal energy to eject ink droplets for recording. Accordingly, the above-prepared east coated papers in Examples III-1 to III-7 and Comparative Examples III-1 and III-2, were used for ink jet recording by using such an apparatus (a color ink jet printer "BCJ-820J", made by Canon K.K.) to evaluate the ink jet recording performances thereof. The results are shown in Table 4 appearing hereinafter.

TABLE 3

| | Gloss (%) | Ink jet recording performance: Ink absorptivity | Image density | Image water resistance | Operability |
|---|---|---|---|---|---|
| Example | | | | | |
| III-1 | 87 | ○ | Δ | ○ | ○ |
| III-2 | 85 | ○ | Δ | ○ | ○ |
| III-3 | 86 | ○ | Δ | ○ | Δ |
| III-4 | 83 | ○ | ○ | ○ | ○ |
| III-5 | 87 | ○ | Δ | Δ | ○ |
| III-6 | 85 | ○ | Δ | Δ | ○ |
| III-7 | 86 | ○ | Δ | Δ | ○ |
| Comp. Example | | | | | |
| III-1 | 90 | X | ○ | ○ | X |
| III-2 | 70 | X | X | ○ | ○ |

TABLE 4

| | Ink jet recording performances: Ink absorptivity | Image density | Water resistance of image |
|---|---|---|---|
| Example | | | |
| III-1 | ◎ | ○ | ○ |
| III-2 | ◎ | ○ | ○ |
| III-3 | ○ | ○ | ○ |
| III-4 | ◎ | ○ | ○ |
| III-5 | ◎ | ○ | Δ |
| III-6 | ◎ | ○ | Δ |
| III-7 | ◎ | Δ | Δ |
| Comp. Example | | | |
| III-1 | x | ○ | ○ |
| III-2 | x | x | ○ |

What is claimed is:

1. A cast coated paper for ink jet recording, comprising, in lamination:

a base paper, a porous undercoating layer comprising a pigment and an adhesive, and a porous and glossy cast-coating layer comprising a polymer having a glass transition point of at least 40° C. formed by polymerization of an ethylenically unsaturated monomer, said cast-coating layer containing a pigment in an amount of 0–200 wt. parts per 100 wt. parts of the polymer, said cast coated paper having an air permeability of at most 300 sec/100 cc.

2. A cast coated paper according to claim 1, wherein said undercoating layer contains a cationic resin.

3. A cast coated paper according to claim 2, wherein said cationic resin comprises a copolymer of a polyalkylenepolyamine and dicyandiamide.

4. A cast coated paper according to claim 1, wherein said cast-coating layer contains silica.

5. A cast coated paper according to claim 1, wherein said undercoating layer contains alumina or silica.

6. A cast coated paper according to claim 1, wherein said cast-coating layer has been formed by applying a cast-coating liquid to form a wet overcoating layer on the undercoating layer on the base paper, and pressing the wet overcoating layer against a heated drum having a mirror-finished surface to dry the overcoating layer.

7. A cast coated paper according to claim 6, wherein the wet overcoating layer is dried in contact with the drum at a temperature below the glass transition point of the polymer.

8. A gloss paper for ink jet recording, comprising, in lamination:

a substrate, a porous undercoating layer comprising a pigment and an adhesive, and a porous and glossy overcoating layer comprising a polymer having a glass transition point of at least 40° C. formed by polymerization of an ethylenically unsaturated monomer; said overcoating layer containing a pigment in an amount of 0–200 wt. parts per 100 wt. parts of the polymer, said gloss paper having an air permeability of at most 300 sec/100 cc.

9. A gloss paper according to claim 8, wherein said undercoating layer contains a cationic resin.

10. A gloss paper according to claim 9, wherein said cationic resin comprises a copolymer of a polyalkylenepolyamine and dicyandiamide.

11. A gloss paper according to claim 8, wherein said overcoating layer contains silica.

12. A gloss paper according to claim 8, wherein said undercoating layer contains alumina or silica.

* * * * *

UNITED STATES PATENT AND TRADEMARK OFFICE

CERTIFICATE OF CORRECTION

PATENT NO. : 5,670,242

DATED : September 23, 1997

INVENTOR(S) : Shinichi ASANO et al.

It is certified that error appears in the above-identified patent and that said Letters Patent is hereby corrected as shown below:

On the title page, items:

[73] Assignees:

"OJI Paper Co., Ltd.," should read --Oji Paper Co., Ltd.,--.

[30] Foreign Application Priority Data:

"226938" should read --5-226938--.

[57] Abstract:

Line 11, "with" should read --has--.

UNITED STATES PATENT AND TRADEMARK OFFICE

CERTIFICATE OF CORRECTION

PATENT NO. : 5,670,242

DATED : September 23, 1997

INVENTOR(S) : Shinichi ASANO et al.

It is certified that error appears in the above-identified patent and that said Letters Patent is hereby corrected as shown below:

In the disclosure:

Column 2:

Line 13, "accomplished" should read --which has been accomplished--.

Column 3:

Line 29, "vinyl-toluene" should read --vinyltoluene--.

Column 4:

Line 38, "paper," should read --paper.--.

Column 5:

Line 23, "a" should be deleted.

UNITED STATES PATENT AND TRADEMARK OFFICE

CERTIFICATE OF CORRECTION

PATENT NO. : 5,670,242
DATED : September 23, 1997
INVENTOR(S) : Shinichi ASANO et al.

It is certified that error appears in the above-identified patent and that said Letters Patent is hereby corrected as shown below:

Column 7:

Line 10, "and" (second occurrence) should read --a--.

Column 8:

Line 5, "lane" should read --line--;
Line 10, "not" should read --not so--; and
Line 62, "belt 59" should read --belt 69--.

Column 9:

Line 40, "pigment," should read --pigments,--;
Line 45, "without" should read --without a--; and
Line 59, "germ" should read --term--.

UNITED STATES PATENT AND TRADEMARK OFFICE

CERTIFICATE OF CORRECTION

PATENT NO. : 5,670,242
DATED : September 23, 1997
INVENTOR(S) : Shinichi ASANO et al.

It is certified that error appears in the above-identified patent and that said Letters Patent is hereby corrected as shown below:

Column 10:

Line 34, "had," should read --hand,--; and
Line 43, "east" should read --cast--.

Column 12:

Line 9, "see/10 cc." should read --sec/10 cc.--.

Column 13:

Line 24, "bale" should read --base--; and
Line 41, "An" should read --A--.

Column 14:

Line 61, "see" should read --same--.

UNITED STATES PATENT AND TRADEMARK OFFICE

CERTIFICATE OF CORRECTION

PATENT NO. : 5,670,242 
DATED : September 23, 1997
INVENTOR(S) : Shinichi ASANO et al.

It is certified that error appears in the above-identified patent and that said Letters Patent is hereby corrected as shown below:

Column 18:

Line 42, "50°C." should read --60°C.--.

Column 19:

Line 9, "car" should read --cat--;
Line 10, "bonic" should read --ionic--; and
Line 21, "idiallylammonium" should read --ldiallylammonium--.

Column 20:

Line 43, "was not flown or blurred" should read --did not flow or blur--.
Line 45, "slightly" should read --being slightly--; and
Line 47, "flown" should read --flowed--.

Signed and Sealed this

Second Day of June, 1998

*Attest:*

Bruce Lehman

BRUCE LEHMAN

*Attesting Officer*

*Commissioner of Patents and Trademarks*